US005577495A

United States Patent [19]

Murphy

[11] Patent Number: 5,577,495

[45] Date of Patent: Nov. 26, 1996

[54] HELMET RESPIRATOR APPARATUS

[75] Inventor: Terence W. D. Murphy, Wilson Gardens, United Kingdom

[73] Assignee: Mine Safety Appliances Company, Pittsburgh, Pa.

[21] Appl. No.: 379,610

[22] PCT Filed: Jul. 30, 1993

[86] PCT No.: PCT/GB93/01616

§ 371 Date: Mar. 16, 1995

§ 102(e) Date: Mar. 16, 1995

[87] PCT Pub. No.: WO94/03235

PCT Pub. Date: Feb. 17, 1994

[30] Foreign Application Priority Data

Jul. 31, 1992 [GB] United Kingdom ..... 9216316
Apr. 5, 1993 [GB] United Kingdom ..... 9303666

[51] Int. Cl.[6] ..... A62B 18/04; A42B 3/28; A42B 3/22

[52] U.S. Cl. ..... 128/201.24; 128/201.22; 128/201.25

[58] Field of Search ..... 128/201.22–201.25; 2/171.3

[56] References Cited

U.S. PATENT DOCUMENTS 4,549,542 10/1985 Chien ..... 128/201.24
4,852,562 8/1989 Howie ..... 128/201.25
5,104,430 4/1992 Her-Mou ..... 55/385.1
5,283,914 2/1994 James ..... 2/424

FOREIGN PATENT DOCUMENTS 2941573 4/1981 Germany ..... 128/201.25

*Primary Examiner*—Edgar S. Burr
*Assistant Examiner*—Daniel J. Colilla
*Attorney, Agent, or Firm*—James G. Uber

[57] ABSTRACT

Respirator apparatus 10, comprises a monocoque helmet 11, with a visor 14, which is pivotal between an inoperative raised position and an operative lowered position. The helmet 11 is formed of outer shells 17, 18 joined together along the rim and at strategic locations within the domed area of the helmet but are selectively spaced apart in various regions to provide an air chamber 19, at the rear of the helmet 11 and an air chamber 20 at the forwar part of the helmet. These chambers 19, 20 are interconnected by three ducts 21, 22, 23. The chamber 19, opens through the outer shell and is fitted with an air filter 25, to receive incoming air. The chamber 20 opens through the inner shell 17 and is fitted with a fan 26 to propel air through the ducts 21, 22, 23 into a breathing zone formed behind the visor 14. The rear portion of the helmet is provided with a chamber 29 which is isolated from the ducts 21, 22, 23 and which accommodates batteries for energizing the fan 26. The visor 14 may be arranged to activate the fan automatically when it is moved to its lowered position.

20 Claims, 2 Drawing Sheets

HELMET RESPIRATOR APPARATUS

FIELD OF THE INVENTION

This invention relates to helmet respirator apparatus which provides protection for the head, face and eyes of a user and delivers filtered air for the user to breathe to protect the user from atmospheres contaminated with dusts, fumes, gases and vapours that are hazardous to health.

BACKGROUND ART

Many forms of respirator apparatus of this type have been proposed and marketed but certain of these are of such a construction that the amount of head protection is less than that which can be provided with a conventional and non-respirated hard hat, and the level of respiratory protection provided in some of these devices is also limited to the lower order of respiratory hazards. There are statutory health and safety regulations in some countries that identify and set standards for protective helmets and respiratory devices. Some examples of these known devices are disclosed in patent specifications—Howie GB 2,201,601,A—Scott GB 2,227,158 and Berg/Kvaal PCT/US81/00244—Vaughan/Wiggins PCT/US82/01154—Gorman U.S. Pat. No. 4,136,688—Schoelz/Tidland U.S. Pat. No. 3,649,946, Chien U.S. Pat. No. 4,549,541—Depping U.S. Pat. No. 3,413,972—Guy U.S. Pat. No. 3,822,698—Grenough G.B. Patent No. 1,426,432, U.K. Patent 1,426,432,—1,495,020—European Patent 0047296, U.S. Pat. Nos. 3,258,010—3,649,964 and 3,822,698.

Examples of devices presently manufactured are the Airstream and Jupiter helmets manufactured by Racal Ltd.; The PF2 and PF3 Helmets manufactured by Pureflo Ltd., and the Clearflow Turbovisor manufactured by Pulsafe Ltd. All of these devices have features that make them difficult, awkward or cumbersome to use.

OBJECT OF THE INVENTION

It is an object of the present invention to provide a new and improved form of helmet respirator apparatus which is easy to use and is of lightweight construction. Other objects and advantages of the present invention will be apparent from the ensuing description of preferred embodiments.

SUMMARY OF THE INVENTION

According to the present invention there is provided respirator apparatus comprising a helmet having a pivotally mounted face shield fitted to the front of the helmet (in the wearing position), the face shield carrying on its edge a flexible sealing member adapted when the face shield is in its lowered or operational position to seal at its lateral edges with the face of a person wearing the helmet, the lower edge of the sealing member defining an exhalate outlet, wherein the helmet comprises a plurality of lightweight shells joined together to form a unitised structure incorporating a plurality of ducts extending between the shells to channel a plurality of air flows from a filtered air intake arrangement in a rear portion of the helmet to an air outlet arrangement at the front of the helmet and behind the face shield, air being powered through the ducts by a motor driven fan forming part of the air outlet arrangement and located within the ducts, and batteries providing a power source for the fan are located within a compartment formed in the rear portion of the helmet and isolated from the ducts, the batteries and air filter being replaceably mounted in the rear portion of the helmet and releasable exteriorly therefrom via apertures formed in the outermost shell of the helmet.

It will be understood that the present invention is also concerned with a respirator apparatus as set forth in the immediately preceding paragraph wherein an air supply is led to the ducts via a hose from an external air source, in which case the helmet may not require to have the air filter and battery modules fitted. The fan may be fitted if so desired but rendered inoperable due to the absence of batteries.

DETAILED DESCRIPTION

Figure 1:
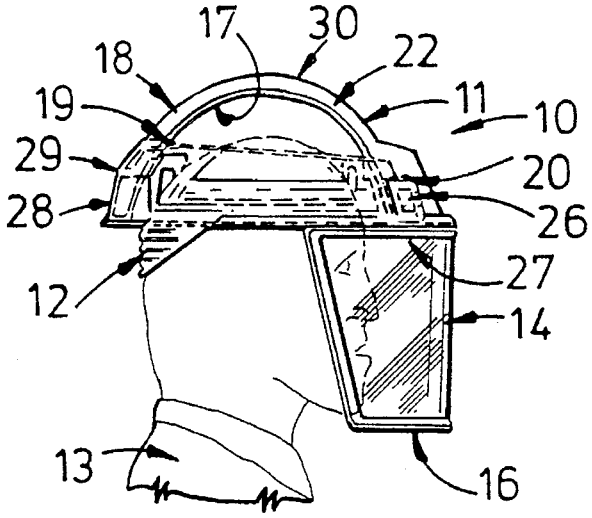
FIG. 1 is a partly sectional side view of a first embodiment of respirator apparatus according to the present invention.
Figure 3:
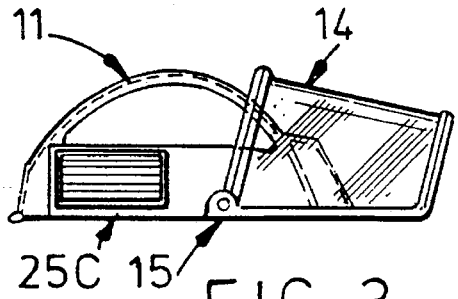
FIG. 3 is a side elevation of the FIG. 1 respirator apparatus with a modified detail.
Figure 2:
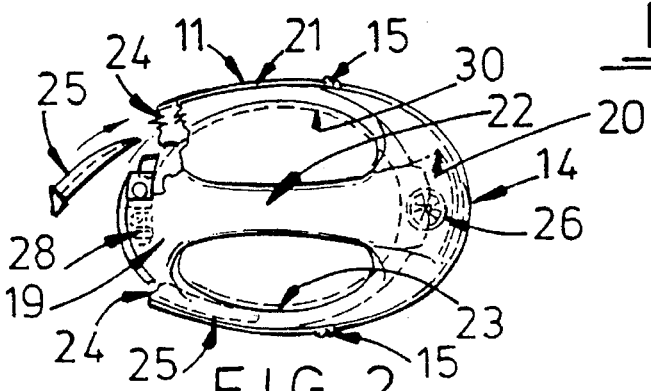
FIG. 2 is a top plan view of the respirator apparatus shown in FIG. 1 and is partially cut away and exploded to illustrate details.

Referring to FIGS. 1, 2 and 3 the first embodiment of respirator apparatus 10 comprises a helmet 11 incorporating a headband arrangement 12 to enable the helmet to be worn by a user 13. Helmet 11 carries a visor 14 which is pivotally mounted at 15 adjacent the rim of the helmet to enable the visor to be moved into and out of position. The peripheral edge of the visor 14 carries a face seal 16 which mates with the face of the user 13 when the visor 14 is in its lowered or operative position (FIG. 1) and establishes a breathing zone for the user 13.

The helmet 11 is formed of inner and outer shells 17,18 which are joined together along the rim of the helmet and at strategic locations within the domed area of the helmet but are selectively spaced apart in various regions to provide an air chamber 19 located generally to the rear of the helmet 11 and an air chamber 20 generally to the forward part of the helmet and these chambers 19,20 are interconnected by three ducts 21,22,23.

Chamber 19 at the rear of the helmet 11 opens through the outer shell 18 to enable a supply of air to be delivered to the ducts 21,22,23 and in this embodiment the opening is formed as two separate apertures 24 disposed on either side of the longitudinal centre line of the helmet 11. Air filters 25 are fitted to the apertures 24 to filter air entering the ducts 21,22,23. Chamber 20 at the front of the helmet is large enough to accommodate a fan 26 to propel air through the ducts 21,22,23 and the chamber 20 opens via a grille 27 through the inner shell 17 into the breathing zone adjacent the wearer's face and behind the visor 14. The fan 26 is powered by batteries 28 which are housed in a compartment 29 formed by shaping the outer shell 18 at the rear of the helmet and centrally disposed. The compartment 29 is isolated from the ducts 21,22,23 and the batteries 28 are removably located in the compartment via an aperture formed in the outer shell 18. Exhalate from the breathing zone issues from the apparatus 10 via an aperture which may be valved in the lower portion of the visor 14.

Figure 6:
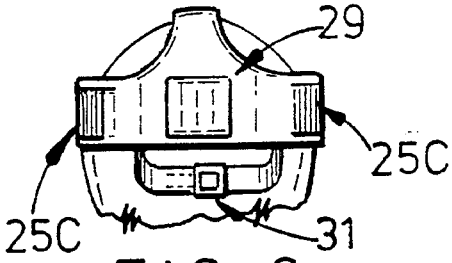
FIG. 6 is a rear view of the FIG. 3 apparatus.
Figure 7:
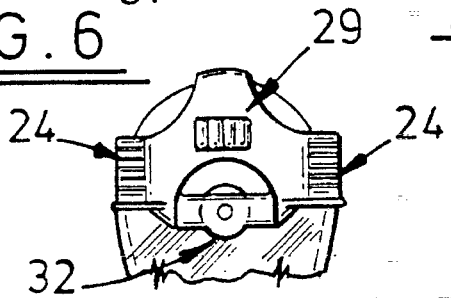
FIG. 7 is a rear view similar to FIG. 6 but showing further modifications.
Figure 12:
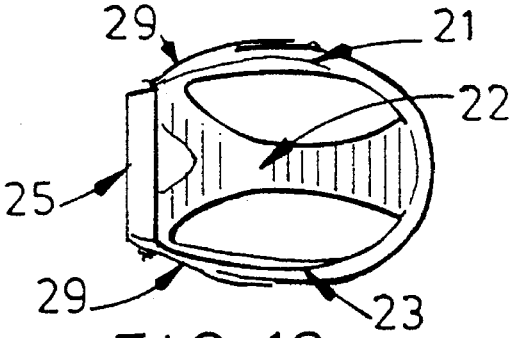
FIG. 12 is a view of the FIG. 9 apparatus taken from above.

The inner and outer shells 17,18 are preferably thermoformed or moulded from a suitable resilient plastic material such as ABS, high impact polystyrene or polypropylene or polycarbonate and each would typically be about 0.5 mm thick over the domed part of the helmet 11 and up to 1.0 mm thick at the helmet rim. The shells 17,18 are generally profiled to define the ducts 21,22,23 which may have a cross-section of about 10 mm by 40 mm (i.e., 1 cm×4 cm). If so desired only outer shell 18 may be contoured (as shown in FIGS. 6, 7 and 12) with inner shell 17 being generally in the form of a smooth dome. The shells 17, 18 are individually flimsy but when bonded together around the rim and in the mating domed areas form a helmet 11 of monocoque construction which is of substantially greater strength than its constituent parts.

To provide the helmet 11 with improved impact properties to enhance the degree of mechanical protection provided to the wearer 13 either the outer shell 18 can be thickened or a third dome-like or intermediate shell 30 may be provided and located between shells 17 and 18 and bonded to at least one of these shells. The intermediate shell 30 may be constructed from a thicker and harder grade of plastic composite material or metal according to the amount of head protection required or may be formed by applying a coating of glass fibre reinforced resin or other suitable composite or plastic material to the appropriate surface of one of the shells 17,18. The outer shell 18 may be colour coded to indicate the level of protection provided by the helmet 11.

Figure 5:
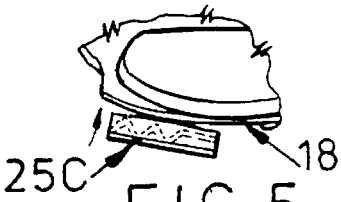
Figure 8:
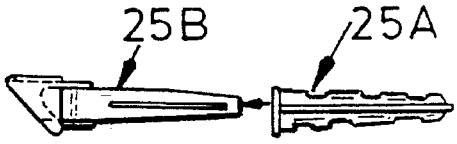
FIG. 8 shows a disassembled part of the FIG. 1 apparatus.

The air filter 25 may take the form illustrated in FIG. 8 which comprises a sock or bag filter element 25A releasably mounted on a rigid holder 25B which incorporates the air inlet grille and is a releasable snap fit to the aperture 24 formed in the outer shell 18. Alternatively, as is illustrated in FIG. 5, the filter 25 may be in the form of a cartridge filter 25C which incorporates its own inlet grille moulding and is fitted to the outer shell 18. The use of a cartridge filter 25C requires a different shape of aperture in the outer shell 18 and this is illustrated in FIG. 3.

Figure 4:
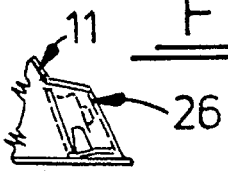
FIGS. 4 and 5 are scrap views to illustrate further modified details.

The fan 26 which is provided in chamber 20 may be an axial fan as illustrated in FIG. 1 or a centrifugal type fan as illustrated in FIG. 4. There is enough space to accommodate either a 60 mm diameter axial fan or an 80 mm diameter centrifugal fan.

The headband arrangement 12 may take any one of a number of different forms such as the conventional snap fastener arrangement 31 shown in FIG. 6 but where the visor 14 is of the type providing protection during a welding operation (shaded glass or liquid crystal shutter) it is desirable for the headband arrangement 12 to be fitted with a rack and pinion adjustment arrangement 32 as illustrated in FIG. 7. This enables operation of the visor 14 between its two positions (compare Figs.1 and 3) to be by way of a nod down of the head of the user 13 provided that the headband arrangement effectively clamps the helmet 11 to the user's head. The adjustment arrangement 32 may require the helmet rim to be locally cut away which in turn requires slight repositioning of the battery compartment 29.

Figure 9:
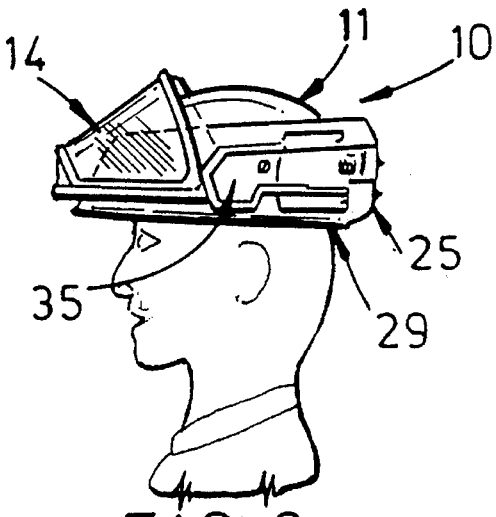
FIG. 9 shows a modified form of the respirator apparatus.
Figure 10A:
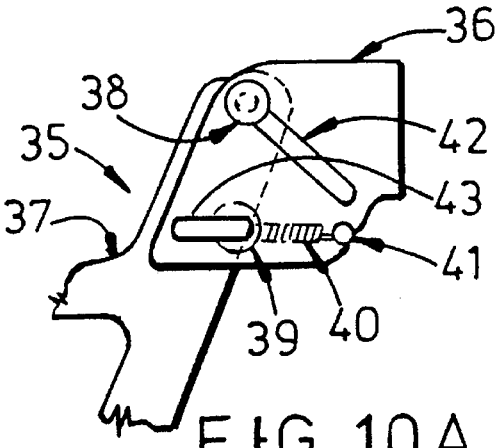
FIGS. 10A and 10B illustrate details of the FIG. 9 apparatus.
Figure 10B:
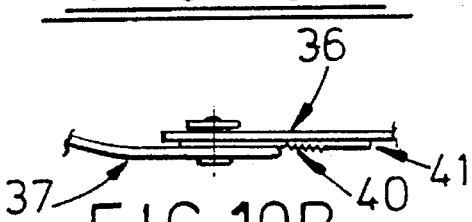
Figure 11:
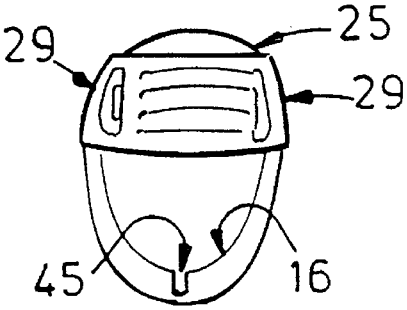
FIG. 11 is a view of the FIG. 9 apparatus taken from the rear.

FIG. 9 shows a form of the respirator 10 in which visor 14 is pivotally mounted to helmet 11 by a modified form of pivot mechanism 35 which is camouflaged by a cover plate in FIG. 9 but is shown in detail in FIGS. 10A and 10B and which is mounted on the helmet 11 above the rim. Mechanism 35 is provided to enable the visor to be a snug fit to the outline of the helmet 11 when the visor 14 is inoperative or in its up position as shown in FIG. 9. Thus, the FIG. 9 construction is more compact i.e. has a lower profile than the FIG. 3 construction which uses a simple pivot 15. Additionally, in FIG. 9 the air filter 25 is centrally located at the rear of the helmet 11 (so that there is only one aperture 24 in this embodiment) and the two battery compartments 29 are provided laterally of the central line, these details being more clearly shown in FIGS. 11 and 12. The rear portion of the helmet 11 is square-cut as shown in FIG. 12 to accommodate the filter 25 which for example is of the pleated cartridge type.

Returning now to FIGS. 10A and 10B which show the mechanism 35, this includes a plate 36 secured to the helmet 11 and having cam slots 42, 43,and a pivot plate 37 carrying the visor 14, and having two retaining locators 38, 39 which move in the slots 42, 43. The retaining locators 38, 39 are formed by small diameter bosses projecting from the pivot plate 37 and which are a sliding fit in the cam slots 42, 43. The bosses terminate in an enlarged head which is greater than the width of the slots 42, 43.

The smaller slot 43 is essentially parallel to the rim line of the helmet 11 whilst the larger slot 42 is angled at about 45° thereto. Thus, when the visor 14 is moved away from its down or operative position adjacent the face of the wearer, it initially pivots about a point on the centre axis of the locator 38. Thereafter, locator 39 moves in a forward direction along the slot 43 whilst the location 38 in slot 42 moves in a direction along and towards the lower end of that slot. Thus the visor 14 moves in a path which ensures that it does not come into contact with the edge of the helmet 11 and in the course of the movement of the locators in the slots, there comes a point in time when they are aligned perpendicularly to the slot 42 whereafter the movement of the locator 39 in slot 43 is reversed so that it moves towards its original position at the back of the slot, and finally movement of the visor ceases when the locator 38 reaches the lower end of slot 42.

A tension spring 40 is mounted between the smaller diameter of the retainer 39 and a mounting post 41 secured to the cam plate 36 and is arranged such that it is extended by approximately 10% of its total length, so that the visor 14 is held under spring pressure in either the up position or the down position. When the visor 14 is in the down position the spring tension pulls the retainer locator 39 towards the back end of slot 43 adjacent to the post 41. The visor 14 is thus held in a snap-like, toggle action in either of its two possible positions and conveniently activates a switch when in its lower operative position in order to energise the fan 26. The switch is preferably mounted at the rim of the helmet 11 and forms part of the fan assembly 26.

The motion of the pivot mechanism 35 in upward pivotal movement of visor 14 is arranged to terminate to prevent the face seal 16 on the peripheral edge of the visor 14 coming into contact with the rim of the helmet 11. However, in the other direction of travel the spring loaded action of the mechanism 35 causes the visor to self seal to the rim of the helmet and the face seal 16 to be pressed against the face of the user 13 to effect a tight sealing action and it is preferred that the face seal 16 is made of a foam rubber-like material, typically between 0.5 and 3 mm thick and containing a radial notch or slot 45 extending approximately 80% of the width of the seal at its centre-most portion. This slot 45 has a dual function which is to provide an exit for exhalate from the breathing zone when the visor is in its operative position and, when the visor is being moved into its operative position, the slot 45 provides an enhanced degree of compliance of the face seal 16 in order to accommodate facial disparities between different users.

The visor 14 of FIG. 9 when in its operative position (shown in FIG. 14) presents a surface extending from the helmet rim to the wearers chin which is inclined inwardly at the chin end which assists in dispersing the air flow from the fan 26 into the breathing zone without a draught of air flowing over the users face.

Figure 14:
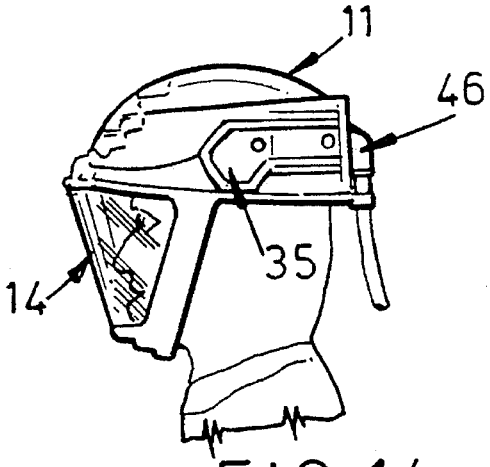
FIG. 13 and 14 illustrate alternative details of the FIG. 9 apparatus.
Figure 13:
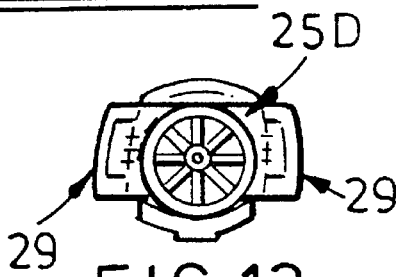

By way of illustration of a modification, FIG. 13 illustrates a canister type of filter 25D which, of course, is fitted to a circular aperture in the outer shell of the helmet 11, whilst FIG. 14 illustrates a supply of fresh air being provided by way of a hose fitting 46 to the aperture 24 in the rear portion of the helmet 11 in substitution for a filter 25.

The respirator assemblies 10 which have been described can be manufactured with a total gross weight as low as 500 grms. Also, all of the devices required to implement a complete respiratory system are incorporated into the assembly 10 with the replaceable components (the batteries 28 and the filters 25A,25B,25C) readily accessible and replaceable from the exterior of helmet 11. The fact that the batteries and filter arrangements are located in the rear portion of the helmet 11 provides for a mechanical balance to the weight at the front of the helmet which is provided by the fan 26 and the visor 14. The filters may take any one of a number of different forms depending upon the degree of filtration required but each is readily releasable and replaceable from the exterior of the helmet 11 by way of a snap-action, toggle, clip or the like fastener. Likewise, the batteries 28 may be part of a modular pack fitted to the helmet 11 by way of a snap-action, toggle, clip or like fastener. The extent to which the filter or battery modules protrude from the profile of the helmet 11 will depend upon the duty of the components and their performance characteristics but for most purposes the protrusion will be minimal.

I claim:

1. A helmet respirator apparatus for a user comprising: a helmet formed from an inner shell having a peripheral rim and a smooth dome shape, and an outer shell having a peripheral rim and profiled to define a plurality of ducts extending from the back of the helmet to the front of the helmet, the inner shell and the outer shell bonded together along their peripheral rims and in between the plurality of ducts to form a unitized lightweight monocoque structure;

a face shield pivotally mounted at the front of the helmet and having a flexible face seal along its lateral edges for sealing against a user's face to create a breathing zone and an exhalation outlet from the breathing zone at the lower edge of the face shield;

a fan compartment formed in the front of the helmet and connected to the plurality of ducts;

a centrally-disposed compartment formed in the back of the helmet and isolated from the plurality of ducts containing a removable battery;

in the back of the helmet, two laterally disposed and mutually opposed removable filters, each connected between the plurality of ducts and an aperture in the outer shell; and a motor-driven fan located in the fan compartment and powered by the battery which when activated causes air to flow through the apertures in the outer shell and into the removable filters, through the removable filters and into the plurality of ducts, through the plurality of ducts and into the fan compartment, through the fan compartment and into the breathing zone.

2. The helmet respirator apparatus of claim 1 wherein there are three ducts, one along the top of the helmet and one along each side of the helmet.

3. The helmet respirator apparatus of claim 2 wherein each duct has a cross-sectional area of about 1 cm×4 cm.

4. The helmet respirator apparatus of claim 1 wherein the inner shell and the outer shell are made from a resilient plastic material.

5. The helmet respirator apparatus of claim 4 wherein the resilient plastic material is selected from the group consisting of polystyrene, polypropylene, polycarbonate and ABS.

6. The helmet respirator apparatus of claim 1 further comprising a third shell located between the inner shell and the outer shell.

7. The helmet respirator apparatus of claim 1 wherein the face shield when sealed against a user's face has an inclined surface which assists in dispersing the air flowing into the breathing zone from the fan.

8. The helmet respirator apparatus of claim 1 further comprising a flexible face seal along the lower edge of the face shield for sealing against a user's chin and an exhalation outlet in the lower portion of the face shield.

9. The helmet respirator apparatus of claim 8 wherein the exhalation outlet comprises an exhalation valve.

10. The helmet respirator apparatus of claim 1 wherein the face seal comprises a foam rubber-like material.

11. A helmet respirator apparatus for a user comprising: a helmet formed from an inner shell having a peripheral rim and a smooth dome shape, and an outer shell having a peripheral rim and profiled to define a plurality of ducts extending from the back of the helmet to the front of the helmet, the inner shell and the outer shell bonded together along their peripheral rims and in between the plurality of ducts to form a unitized lightweight monocoque structure;

a face shield pivotally mounted at the front of the helmet and having a flexible face seal along its lateral edges for sealing against a user's face to create a breathing zone and an exhalation outlet from the breathing zone at the lower edge of the face shield;

a fan compartment formed in the front of the helmet and connected to the plurality of ducts;

a centrally-disposed compartment formed in the back of the helmet and connected between the plurality of ducts and an aperture in the outer shell and containing a removable filter;

in the back of the helmet, two laterally disposed and mutually opposed battery compartments, each isolated from the plurality of ducts and containing a removable battery; and a motor-driven fan located in the fan compartment and powered by the battery which when activated causes air to flow through the aperture in the outer shell and into the removable filter, through the removable filter and into the plurality of ducts, through the plurality of ducts and into the fan compartment, through the fan compartment and into the breathing zone.

12. The helmet respirator apparatus of claim 11 wherein there are three ducts, one along the top of the helmet and one along each side of the helmet.

13. The helmet respirator apparatus of claim 12 wherein each duct has a cross-sectional area of about 1 cm×4 cm.

14. The helmet respirator apparatus of claim 11 wherein the inner shell and the outer shell are made from a resilient plastic material.

15. The helmet respirator apparatus of claim 14 wherein the resilient plastic material is selected from the group consisting of polystyrene, polypropylene, polycarbonate and ABS.

16. The helmet respirator apparatus of claim 11 further comprising a third shell located between the inner shell and the outer shell.

17. The helmet respirator apparatus of claim 11 wherein the face shield when sealed against a user's face has an inclined surface which assists in dispersing the air flowing into the breathing zone from the fan.

18. The helmet respirator apparatus of claim 11 further comprising a flexible face seal along the lower edge of the face shield for sealing against a user's chin.

19. The helmet respirator apparatus of claim 18 wherein the exhalation outlet comprises an exhalation valve.

20. The helmet respirator apparatus of claim 11 wherein the face seal comprises a foam rubber-like material.

* * * * *